United States Patent [19]

Mosteller, Jr.

[11] 4,379,237

[45] Apr. 5, 1983

[54] LIGHT INTENSITY CONTROL DEVICE AND CIRCUIT THEREFOR

[76] Inventor: Lawson P. Mosteller, Jr., 7404 Farnum St., Springfield, Va. 22151

[21] Appl. No.: 303,066

[22] Filed: Sep. 17, 1981

[51] Int. Cl.[3] ..... H01H 43/00; H05B 39/02

[52] U.S. Cl. ..... 307/141; 315/194

[58] Field of Search ..... 307/590, 597, 141; 315/194, 199; 361/197, 198

[56] References Cited

U.S. PATENT DOCUMENTS

| | | | |
|---|---|---|---|
| 3,732,484 | 5/1973 | McKenna | 315/DIG. 4 |
| 3,798,889 | 3/1974 | Chadwick | 58/19 C |
| 3,814,950 | 6/1974 | Adams | 307/141 |
| 3,893,002 | 7/1975 | Woodnutt | 315/199 |
| 3,898,516 | 8/1975 | Nakasome | 315/199 |
| 3,949,241 | 4/1976 | Maute | 315/360 |
| 3,979,601 | 9/1976 | Franklin | 315/194 |
| 3,991,343 | 11/1976 | Delpy | 315/360 |
| 4,008,416 | 2/1977 | Nakasome | 315/199 |
| 4,037,135 | 7/1977 | Novey | 315/194 |
| 4,038,561 | 7/1977 | Lorenz | 307/141 |
| 4,082,961 | 4/1978 | Genuit | 315/199 |
| 4,144,478 | 3/1979 | Nuver | 315/199 |
| 4,152,607 | 5/1979 | Nakasome | 315/194 |
| 4,152,608 | 5/1979 | Nakasome | 315/194 |
| 4,159,442 | 6/1979 | Komatso | 315/199 |
| 4,160,192 | 7/1979 | McAllise | 315/DIG. 4 |
| 4,220,910 | 9/1980 | Chiba | 315/194 |

FOREIGN PATENT DOCUMENTS

| | | | |
|---|---|---|---|
| 2509527 | 9/1976 | Fed. Rep. of Germany | 307/141 |

*Primary Examiner*—Donald A. Griffin

*Attorney, Agent, or Firm*—Shlesinger, Arkwright, Garvey & Dinsmore

[57] ABSTRACT

A device for producing a gradual change in power supplied to a load which utilizes at least one gated solid state switching device and a selectable variable timer network connected to the gate electrode and comprising a chargeable capacitor and a switchable resistive network, for controlling a light circuit, for example.

17 Claims, 3 Drawing Figures

LIGHT INTENSITY CONTROL DEVICE AND CIRCUIT THEREFOR

This invention relates to a light intensity control device and circuits for the device for controlling the intensity and the rate of change of intensity of a light or lighting system.

BACKGROUND OF THE INVENTION

In the past, a number of different types of dimmer switches have been known both for incandescent and fluorescent lighting systems. While the most common control for lights or lighting systems has been the on/-off switch, manual dimmer switches have increased in popularity because of the flexibility they offer the user to control the lighting in a room to the desired and most comfortable intensity.

Such manually operated dimmer switches are readily available commercially and are well known in the art. These manually operated light dimmer switches typically control the brightness of the light by controlling the resistance of a manually operated variable resistor in the control circuit of a silicon controlled rectifier which in turn controls the amount of current to the electric light bulb and thereby controls the brightness or intensity of the light emitted. In addition, such prior art dimmer switches frequently also include an instant on-instant off capability.

The human eye requires approximately 15 minutes to fully adjust from a dark environment to a normal, well-lighted environment, or vice versa. Rapid changes from dark to normal lighting conditions causes unpleasant sensations in the human eye and indeed may even cause flash blindness in extreme cases. Upon going from light to near darkness, a person cannot see well until his eyes adjust. This condition can be particularly noticeable by a person developing film in a dark room, for example, where certain operations are performed in total darkness while others are performed at normal light intensity levels, or even by a person trying to locate a door or some other object, such as a bed, in a dark room after the light has been turned off. In addition, there are frequently periods of time after an eye operation when abrupt changes in light intensity from dark to bright could be very painful, if not harmful to the patient.

Further, it is often unpleasant and frequently more difficult for a person to awaken early in the morning before dawn and while it is still dark, than it is to awaken after dawn when the eye is partially adjusted to the light through the eyelid. A more natural method of awakening a person in a pleasurable manner is the gradual lighting of the area around the person as produced by the rising of the sun.

Unfortunately, commercially available dimmer switches, while capable of gradually increasing the light intensity, cannot do so in an automatic manner since an individual must gradually turn the control knob in order to gradually increase the intensity, giving rise to an inconvenience which would ordinarily prevent the dimmer switch from being used in this manner.

The prior art reveals a number of devices for gradually increasing the intensity of a light or gradually decreasing the intensity. For example, U.S. Pat. No. 3,798,889 discloses an artificial sun rise producing device which utilizes a tapered slit to control the amount of light reaching a light sensitive resistor for controlling the intensity of the lighting system.

More recently, a number of solid state devices such as triacs, diacs, programmable unijunction transistors, light emitting diodes, and the like have been used for controlling light dimmers in a progressively variable manner. Such devices are typified by U.S. Pat. Nos. 3,898,516, 4,008,416, 4,152,607, 4,152,608, 4,144,478, 4,159,442, 4,082,961, and 3,893,002.

OBJECTS OF THE INVENTION

A primary object of this invention is to provide a control circuit capable of automatically varying over a preselected time interval the rate of change in intensity of a light or lighting system.

Another object of the present invention is to provide a light control circuit capable of gradually increasing the light intensity from a full off position to a preselected level of intensity.

A further object of the invention is to provide a simple electro-optical control circuit capable of automatically varying over a preselected time interval the resistance of an electro-optical device in a continuous and gradual manner from high resistance to low resistance and vice versa upon manual or timer initiation.

Yet another object of this invention is to provide a lighting control circuit wherein the duration of the gradual change may be varied from nearly instantaneous to tens of minutes or longer.

Yet a further object of this invention is to provide a light control circuit for varying the light intensity after manual or timer initiation in a gradual and continuous manner over a preselected time interval.

Still a further object of this invention is to provide a lighting control circuit having the capability for manual instant on/off, for manual dimming, and for preselection of the final brightness level of the automatic gradual on/off operation.

Still another object of this invention is to provide an artificial dawn and an artificial dusk at a preselected time.

Still another object of this invention is to provide an automatic light intensity control switch which may fit into an ordinary electric light switch junction box.

Yet a further object of the present invention is to provide an automatic electric light control for gradual on/off operations which is silent after the sequence is initiated.

Yet a further object of the present invention is to provide an automatic light intensity control switch.

These and other objects and advantages of the present invention will become apparent when considered in light of the following description and claims when taken together with the accompanying drawings.

DESCRIPTION OF THE INVENTION

Figure 1:
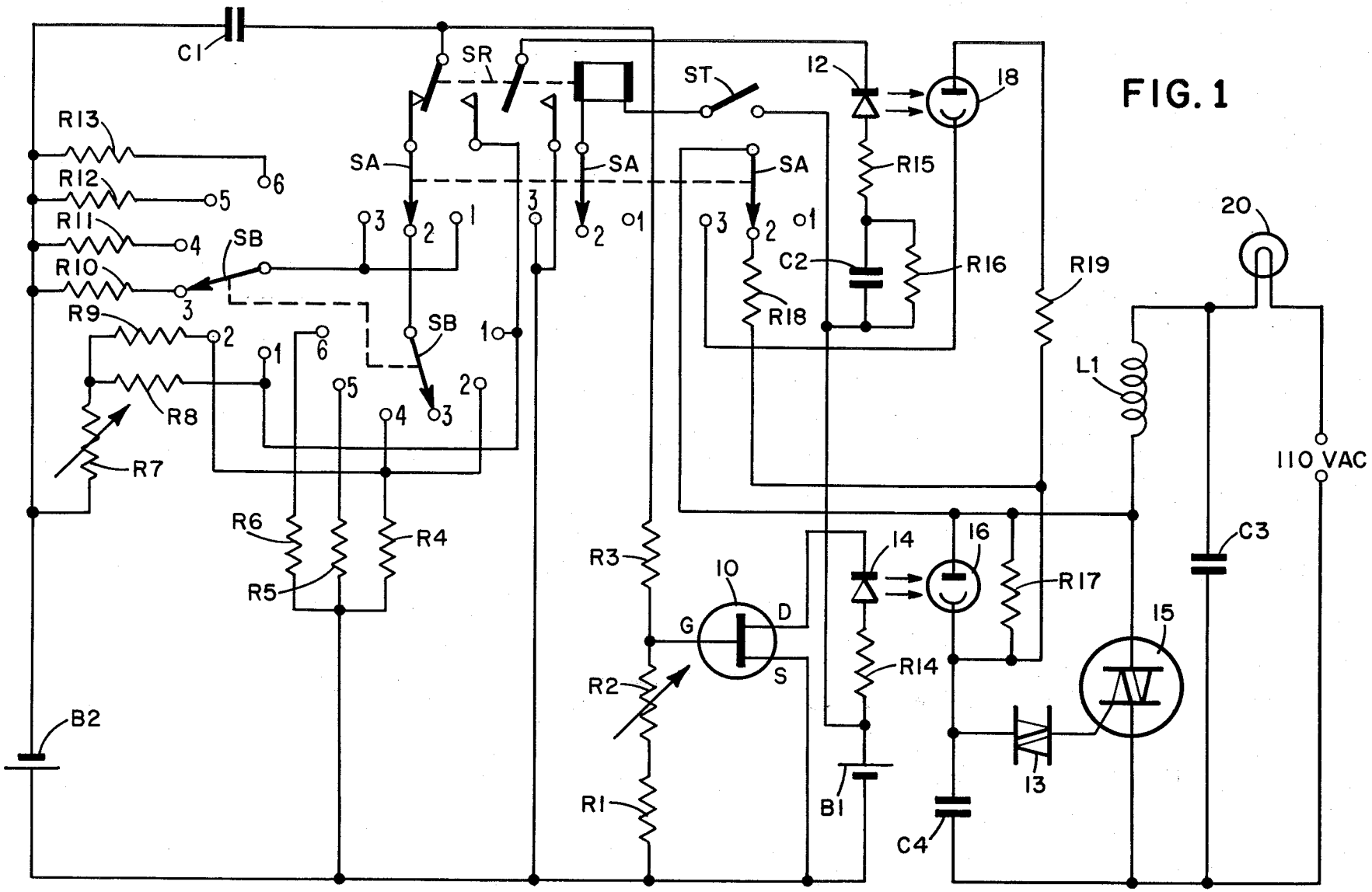
FIG. 1 shows one embodiment of a lighting control circuit according to the present invention using light emitting diodes and photoconductors in the control circuit.

Referring firstly to the embodiment of FIG. 1, a schematic diagram of the circuit of the present invention for use with incandescent lights is shown. The circuit utilizes batteries (or power supplies) B1 and B2, typically a 9 volt power supply at B1 and a 9 volt battery at B2, capacitors C1 and C2, resistors R1 through R16, switches SA and SB, timer switch ST, relay switch SR, n-channel field effect transistor (JFET) 10, and light emitting diodes 12 and 14, all of which are in a first portion of the circuit.

The second portion of the circuit which is electro-optically coupled to the first portion includes photoconductors 16 and 18, resistors R17, R18, and R19, and switch SA substituted for the manually operated variable resistor of a standard, well-known type of manually operated incandescent light dimmer switch which normally also includes choke L1, capacitors C3 and C4, and the diac 13 and triac 15.

With switch SA initially at position 2, switch SB at position 3, and capacitor C1 discharged, the current through capacitor C1 and resistors R1, R2 and R3 (R2 is normally set to full value) makes the gate, G, voltage of the JFET 10 sufficiently negative to prevent the required drain, D, current to light the LED 14. As the capacitor C1 charges through resistors R1, R2 and R3, the gate voltage gradually increases permitting the brightness of the LED 14 to vary gradually from an imperceptible level to the maximum brightness allowed by the current limiting resistor R14 in the drain circuit for a zero gate voltage. The LED 14 reaches full brightness when capacitor C1 becomes fully charged to the voltage of battery B2, i.e. 9 volts. The charging time is determined by the C1 (R1+R2+R3) time constant.

Starting with capacitor C1 fully charged to the battery voltage, i.e. 9 volts, LED 14 can be turned off or dimmed gradually by rotating switch SA to position 1 or 3 to discharge the capacitor C1 through resistor R10 and thereby decrease the gate voltage at the JFET 10. Resistor R10 is selected so that the LED 14 just goes out or reaches the desired minimum brightness upon capacitor C1 discharging to the voltage determined by the resistive network R1, R2, R3 and R10 and the battery B2.

When the switch SA is at position 3 and LED 14 is off, the "gradual on" sequence can be initiated automatically by a timer switch ST which activates relay switch SR to disconnect resistor R10, to connect resistors R7 and R8, and to apply the power supply voltage (9 volts) to the LED 12. Disconnecting the resistor R10 permits capacitor C1 to charge gradually to increase slowly the brightness of LED 14 to the brightness level determined by the setting of variable resistor R7. If variable resistor R7 is set at its maximum value, capacitor C1 charges sufficiently to bring the LED 14 nearly to full brightness, since at that JFET gate voltage, the current through LED 14 is primarily governed by the value of the current limiting resistor R14. If the variable resistor R7 is set to its lowest value (0), LED 14 will not increase in brightness after relay switch SR is activated. However, if the variable resistor R7 is set for some intermediate value LED 14 will increase in brightness to a level governed by the resistance of R7.

Applying the 9V power supply voltage to the LED 12 portion of the circuit momentarily lights LED 12. At first, the current in LED 12 is limited by resistor R15, but then decreases quickly as capacitor C2 charges, to the minimum current determined by resistors R15 and R16 for a 9 volt source. Capacitor C2 and resistor R15 are so choosen as to make the LED 12 flash on and off once upon the activation of switch SR by the timer switch ST, and resistor R16 is so chosen that it discharges capacitor C2 quickly without permitting excessive minimum LED 12 current.

The timer is a standard 110V A.C. security light timer that has been modified so that it closes a set of contacts at "on" time and open these contacts at "off" time without supplying 110V A.C. to the circuit controlled by those contacts. This timer switch ST activates relay switch SR upon closing and deactivates this switch upon opening.

With the timer on and LED 14 at full or intermediate brightness, the "gradual off" sequence can be initiated automatically by the timer opening the circuit to relay switch SR at a preselected time, or manually by rotating switch SA to position 1 so as to connect resistor R10 and to open the circuit to relay switch SR.

The LED 14 will remain on and increase gradually to full brightness, if not already there, when switch SA is rotated to position 2 before the timer opens the circuit to the relay switch SR.

The first portion of the circuit thus far described is coupled with the second portion of the circuit by placing the LED's 12 and 14 respectively close to photoconductors 18 and 16. This portion of the circuit is a standard manually controlled incandescent light dimmer switch with the manually controlled variable resistor replaced by photoconductors 16 and 18, R17, R18, R19, and switch SA. Starting with switch SA at position 1, and LED 14 at minimum brightness, upon moving switch SA to position 2, the light bulb 20 comes on at a dim glow (resistors R17 and R18 are selected such that they, in parallel, provide the maximum resistance that permits the electric light to turn on at minimum brightness). Then, as LED 14 gradually brightens, the resistance of photoconductor 16 gradually decreases which in turn gradually increases the brightness of the electric light 20 to full on as LED 14 reaches maximum brightness.

When the switch SA is rotated to position 1 or 3, the electric light 20 gradually dims continuously to completely off as LED 14 dims to minimum brightness. The resistor R17 is selected so that it, in parallel with photoconductor 16 will provide sufficient resistance when photoconductor 16 is about 1 MΩ to distinguish the electric light. With switch SA at position 3 and the electric light fully off, upon timer switch ST activation of the relay switch SR, the LED 12 flashes on and dims quickly to lower momentarily the resistance of photoconductor 18 sufficiently for the electric light 20 to come on at minimum "initial on" brightness and then to dim instantaneously to a much lower level before gradually increasing in brightness to full on. The gradual "off" sequence can be initiated automatically at a preselected time by the timer or manually by rotating switch SA to position 1. However by moving switch SA to position 2 before the relay switch SR deactivates, the light remains on at full brightness upon timer switch ST deactivation of relay switch SR.

The variable resistor R2 provides the capability of manually controlling the brightness of the electric light. With switch SA at position 1 or 3, and the light out, and relay switch SR deactivated, decreasing the value of variable resistor R2 from the normally full values setting, instantaneously turns the light emitting diode 14 on and thus the electric light on, and then continuously increases the brightness of the light emitting diode 14 and the electric light to full brightness as the value of the variable resistor R2 is further decreased to 0. Then, increasing the resistance of the variable resistor R2 decreases the brightness of the LED 14 and the electric light. With the switch SA at position 1 or 3 and the variable resistor R2 set at an intermediate value, upon rotating switch SA to position 2, the brightness of the light emitting diode 14 and electric light 20, originally at an intermediate brightness, gradually increases in brightness to full on. With the light emitting diode 14 and the electric light 20 fully on, rotation of switch SA to either position 1 or 3 will cause light emitting diode 14 and light 20 to gradually dim to the brightness level determined by the resistive value of variable resistor R2.

Positions 3, 4, 5 and 6 of switch SB provide a choice of different "gradual on" and "gradual off" time durations. The operation of these gradual on/off sequences are identical to that for position 3 of switch SB except for the duration. Table 1 gives suitable values for the various components used in the FIG. 1 embodiment. With the values as specified in Table 1, position 3 of switch SB provides "gradual on" or gradual off" duration of about six minutes, position 4 about four and one half minutes, position 5 about two minutes, and position 6 about three seconds. The time duration for the "gradual on" or "gradual off" sequences could be increased almost without limit by properly increasing the sizes of resistors R1, R2 and R3 and capacitor C1, and the minimum time could be reduced to zero by making R6 and R13 zero, provided that resistors R6 and R13 were decoupled in the "gradual off" mode by using another switching arrangement to avoid shorting of the power supply B2.

TABLE I

| | |
|---|---|
| C1 - 100MF | R9 - 340K |
| C2 - 50MF | R10 - 590K |
| JFET - HEP - F0021 | R11 - 340K |
| LED12 & LED14 - HED - P2000 | R12 - 200K |
| R1 - 470K | R13 - 5K |
| R2 - 1M | R14 - 3K |
| R3 - 5.7M | R15 - 10K |
| R4 - 8M | R16 - 150K |
| R5 - 3.3M | R17 - 85K |
| R6 - 68K | R18 - 690K |
| R7 - 5M | R19 - 690K |
| R8 - 590K | PC16 & PC18 - PHOTOCONDUCTORS |

Positions 1 or 2 of switch Sb and variable resistor R7 provide the capability for the selection of the light emitting diode 14 and thus the electric light 20 terminal brightness at the end of a "gradual on" or "gradual off" sequence and in addition to provide the capability for gradual change in the LED 14, and thus the electric light 20, brightness from any brightness level within the full range from off to fully on to any other brightness level. This process is gradual because the state of charge of capacitor C1, which governs the brightness of LED 14 and thus the light 20, changes only by current flowing through the resistive network connected to capacitor C1. With the resistive value of variable resistor R7 set to zero and switch SB at position 1 or 2, LED 14 and thus the electric light 20 gradually dims to completely off with position 1 of switch SB being the slower. Setting the variable resistor R7 to the maximum value causes the light to gradually brighten to fully on when switch SB is at position 1 or 2.

A variable intensity fluorescent light dimmer circuit also has a variable resistor that controls the brightness of the light. By replacing this variable resistor by a set of resistors and photoconductors similar to that of R17, R18, R19, photoconductors 16 and 18, and switch SA, and by controlling the resistive values of these photoconductors with a circuit similar to that of the first portion of FIG. 1, all of the gradual variations in brightness described above for incandescent light would also be provided for fluorescent light.

Different applications for the present invention utilize different combinations of the switches and networks of FIG. 1. Other applications could use different combinations or even different sets of networks. In the first application, the complete circuit as shown in FIG. 1 would most likely be used, and the timer switch plays a key role. A primary function is to provide an artificial dawn in a bedroom before a person is awakened by a preset alarm during non-daylight hours.

When switch SA is set to position 3 to dim the light gradually to completely off with switch SB at position 3, 4, 5, or 6, the switches are properly set for the preset timer switch ST to activate relay switch SR to initiate automatically the "gradual on" sequence to provide the artificial dawn. It is in this application where it is important that the light starts the "gradual on" sequence from a very low level that the flashing of LED 12 plays an important role in initiating "turn on" of the electric light at the minimum "turn on" brightness and then immediately lowers the brightness to a dim glow before starting the gradual increase in brightness to the final level established by the setting of variable resistor R7.

It should be noted that neither resistors R4, R5 nor R6 is in parallel with the R1, R2, and R3 resistive network when the relay switch SR is activated to provide a "gradual on" duration of six minutes or greater which is independent of the "gradual off" selection.

In addition to providing an artificial dawn light, this invention also provides a manually initiated "gradual on"/"gradual off" control circuit with preselected time durations, a control circuit to gradually vary the brightness of a light from one level to another, an ordinary on/off switch by using the fast "gradual on/gradual off" selection and a manually operated dimmer switch that provides instant variation in brightness over the complete range from off to full on by rotating a knob.

In another application of the invention thus far described, the artificial dawn option need not be provided and variable resistor R2 could be replaced by a fixed resistor and variable resistor R7 could be omitted. This version of the invention provides a two switch electric light control circuit to provide up to six "gradual on" and six "gradual off" time durations ranging from about three seconds to six minutes or longer if desired. The control system could be housed in a container which could be easily inserted into an ordinary wall switch box. This embodiment of the invention could be used in a bathroom or any other place where the light normally would be turned on after a person's eyes have adjusted to the darkness or where it would be convenient for a person to see for a short time after the light switch has been turned off. For example, the device could be used in an infant's room to avoid the instant turning on of a light to full brightness while providing instant light at a low level sufficient for seeing, and then gradually increasing to a brighter level. The "gradual off" mode would also avoid awakening an infant as often occurs when a room light is turned off instantaneously shortly after the infant is put to bed for the night. Of course it would also lessen the likelihood of awakening a child when the light is turned on instantaneously. Alternatively, a single two-pole/six-throw switch could be used in place of the two switches mentioned above to provide three different "gradual on/gradual off" times.

Figure 2:
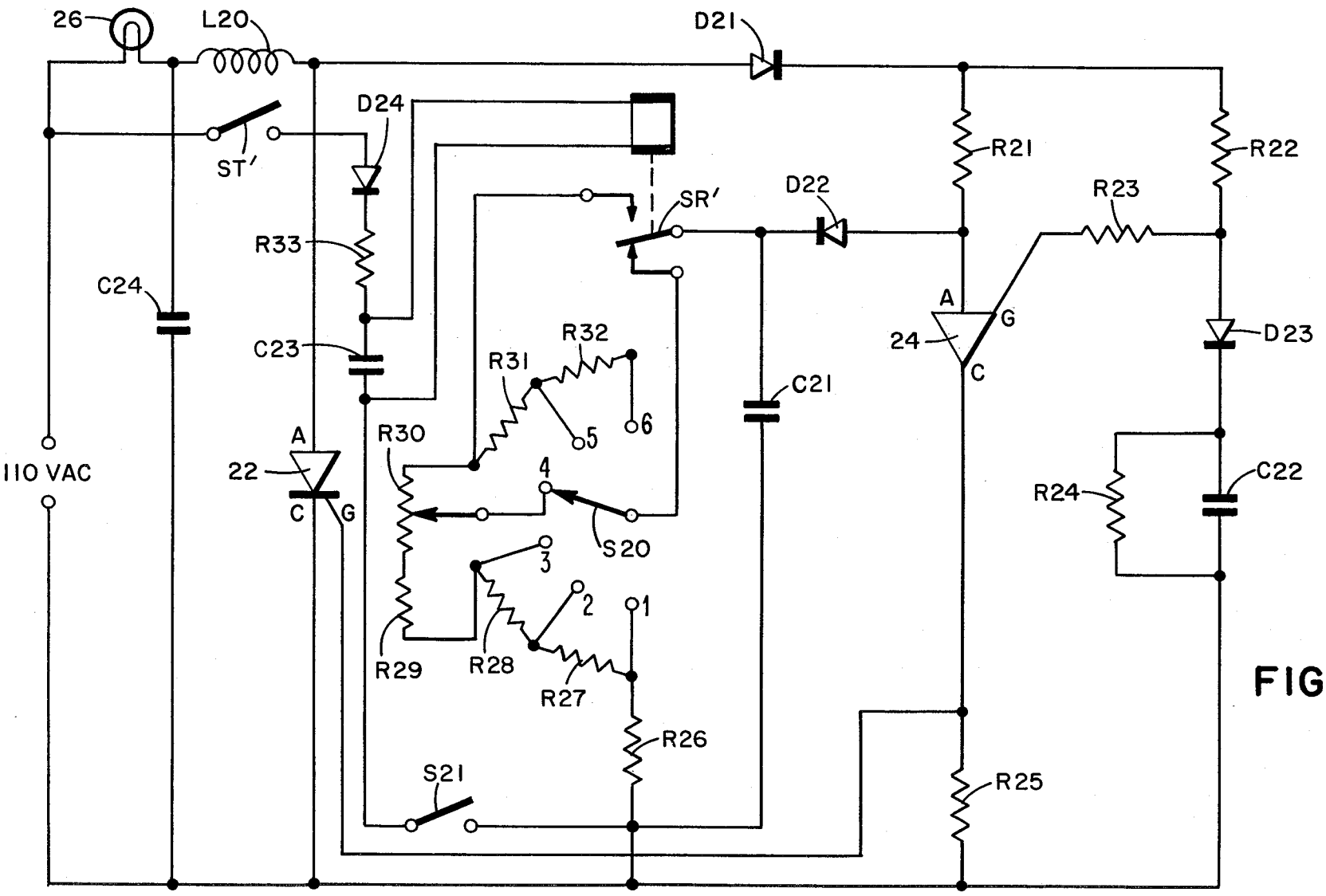
FIG. 2 shows an alternate embodiment of the circuit according to the present invention using a programable unijunction transistor with a silicon controlled rectifier.

Another embodiment of the present invention is shown in FIG. 2, and has the major advantage of operating directly on ordinary household line voltage, e.g. 110V A.C. without the need for batteries, transformers, power supplies or the like.

The circuit of FIG. 2 includes a silicon controlled rectifier (SCR) 22, a programmable unijunction transistor (PUT) 24, an incandescent light bulb or lighting system 26, diodes D21–D24, capacitors C21–C24, resistors R21–R33, switches S20–S21, relay switch SR', timer switch ST' and coil L20.

With the circuit in steady state condition with relay switch SR' open and switch S20 at position 1, 2 or 3, the voltages at the anode A and the gate G of the PUT 24 are nearly equal. In this state, PUT 24 does not conduct, as it only conducts when the voltage on the anode A is greater than the voltage on the gate G by the threshold value. If switch S20 is now moved to position 5, the light 26 comes on at a dim glow and gradually increases in brightness to full or nearly full brightness over a time interval equal to about three minutes. During this time interval, the conduction initiation point of the PUT 24 is initially at about the 180° point of the positive half cycle and then gradually decreases to about zero degrees. During this same time interval, the SCR 22 starts conducting initially at about the 180° degree point of each positive half cycle and then gradually changes the conduction initiation point to about the zero degree point of each positive half cycle. Since the SCR 22 conducts only for the remainder of each positive half cycle after the SCR gate G has been triggered by voltage which is positive with respect to the cathode, the fraction of the positive half cycle during which the SCR 22 conducts, varies gradually from zero when the PUT 24 is in the off state for whole cycle to 100% when the PUT 24 conducts at the beginning (zero degree point) of the positive half cycle.

If switch S20 had been moved to position 6 instead of position 5, the light would have immediately come on at a low intensity, brighter than the initial low intensity of position 5 and gradually increased to full brightness in about 30 seconds. Likewise if switch S20 had been moved to position 4 instead of position 5, light 26 would have come on at a faint glow and then gradually increased in intensity to full brightness in about 15 minutes provided that the variable resistor R30 is rotated to a full resistance position in the circuit. The purpose of the variable resistor R30 will be described below. With the light at maximum brightness for switch S20 at positions 4, 5 or 6, upon rotating switch S20 to positions 1, 2 or 3, the light gradually dims to completely off in about 30 seconds, three minutes or 15 minutes respectively.

The gradual on and gradual off times given above are for the values of the components as listed in Table 2 however other times may be provided by using intermediate values for resistors R26–R32 provided that the sum of R26, R27 and R28 remains constant. Sufficiently large relative increases in resistance in parallel with capacitor C21 when switch S20 starts at position 1, 2 or 3 causes the light when off, to turn on immediately at full brightness. Likewise, a sufficiently large relative decrease in the resistance in parallel with capacitor C21 causes a fully on light to go out immediately.

TABLE II

| | |
|---|---|
| SCR - HEP - R1218 | R25 - 1K |
| PUT - HEP - S9001 | R26 - 15K |
| D21 - D24 - HEP - R0052 | R27 - 16.5K |
| C21 C23 - 10MF - electrolytic | R28 - 5.6K |
| C24 - 0.1MF | R29 - 1K |
| SR - Calectro - D1 - 962 | R30 - 2K variable |
| R21 - 100K | R31 - 6.8K |
| R22 - 4.7M | R32 - 120K |
| R23 - 100K | R33 - 15K |
| R24 - 1.8M | |

*R23 can be 0 if R22 is sufficiently large to prevent excessive gate current in PUT 24.

The intensity of the light 26 at initial on, when switch 20 is turned to position 4, 5 or 6 from position 1, 2 or 3 varies in direct proportion to the resistance in parallel with capacitor C21. At position 4, the light comes on so faintly that the glowing filament in the electric light bulb is just visible in a dark room. At position 5, the initial brightness of the light is sufficient for a person whose eyes are sufficiently adjusted to the dark to see most objects in a previously dark room without unpleasant sensations to the eye. At position 6, the light intensity starts at about half of full brightness.

By adjusting the variable resistor R30, the final brightness of the light may be preselected for position 4 of switch S20 without changing the gradual on/off timing sequence for any other setting of switch S20. The variable resistor R30 provides the full range control of the final light brightness from fully on to completely off. Further, the light gradually changes from one steady state partial brightness level to another steady state partial brightness level when R30 is adjusted.

Capacitor C22 partially charges during each positive half cycle when the SCR 22 is non-conducting, and partially discharges during the time that SCR 22 is conducting, and during each negative half cycle. When the circuit is in the "gradual on" sequence, capacitor C22 discharges more than it charges, thereby producing a net effect of a slow discharge. On the other hand, during the gradual off sequence, capacitor C22 charges more than it discharges thereby producing a net effect of a slow charge. When the control circuit is set to produce a steady state "partial on" condition, and the circuit has reached this state, capacitor C22 charges and discharges an equal amount during each cycle, thereby maintaining a constant bias on the gate of the PUT 24 within a range such that the PUT 24 anode voltage control circuit causes the PUT 24 to fire at the same phase point in each cycle of the applied 110V A.C. power.

If the values of resistors R22 and R24 or of capacitor C22 are doubled (or halved), the time duration for gradual-on and gradual-off sequence will increase (or decrease) by a factor of about 2. Therefore, it is possible by using the proper choice of resistors R21 through R32 and capacitors C21 and C22, to obtain essentially any desired duration for the gradual-on or gradual-off modes. Also by using different suitable values for the resistors R21 through R32 and capacitors C21 and C22, for each case any gradual-on or gradual-off duration from seconds to hours may be achieved with the brightness of the light 26 traversing the full range of intended change in illumination from fully off to completely on and vice versa, or between any two dimmed or partially on steady state levels.

Since the circuit of FIG. 2 controls only the positive half-cycle of the applied voltage while blocking the negative half-cycle, the electric light bulb when fully on, as described above emits light at less than half the rated intensity. By using a sufficiently high wattage light bulb, adequate intensity can be produced with increased bulb life, and of course if necessary additional light bulbs may be placed in parallel.

The circuit of FIG. 2 may be used as a dawn light control system when switch S21 is closed. Under normal operating conditions, the timer switch ST' would energize the relay switch SR' only when switch 20 is in positions 1, 2 or 3 so that the light bulb would be off. With the light off (switch S20 at positions 1, 2 or 3), and switch S21 closed, upon automatic closure of the timer switch ST' at the preset time, the light comes on at a very faint glow and gradually increases in brightness to full intensity in about 15 minutes to simulate the natural dawn.

If timer switch ST' or switch S21 is opened after the light is completely on, the light will gradually dim to completely off in about 15 minutes, three minutes, or 30 seconds when switch S20 is respectively in positions 3, 2 or 1. If switch S20 is in position 4, 5 or 6 and the light is fully on when the timer switch ST' or switch S21 is opened, the light remains fully on. If the light 26 is partially on when relay switch SR' is activated, the light 26 gradually increases in brightness to full intensity in time, less than 15 minutes, that is inversely proportional to the brightness of the light upon relay switch SR' activation. If relay switch SR' is deactivated when the light is partially on, the light gradually increases from that brightness to full intensity in less than 15 minutes, three minutes, or 15 seconds if switch S20 is respectively in position 4, 5 or 6, where alternatively it decreases from that brightness to completely off in less than 30 seconds, three minutes or 15 minutes if switch S20 is respectively in positions 1, 2 or 3.

Capacitor C24 and coil L20 provide a filter which greatly decreases or eliminates any interference with radios, and these components prevent sharp spikes of current through the light 26. They are similar to and provide the same function as the coil and capacitor filter on standard, manually operated variable intensity switches.

Thus the circuit of FIG. 2 provides an automatic artificial dawn producing device when the timer switch ST' energizes the relay switch SR' with the light initially completely off and switch S20 in position 1, 2 or 3. Further, the device produces an automatic artificial dusk, when the timer switch ST' de-energizes relay switch SR' while the light is on, and switch S20 is in positions 2 or 3.

In addition the light control circuit can keep the light intensity at any desired level between completely off and fully on, and can gradually vary the light intensity from any intermediate level to any other intermediate level including fully on and completely off, thereby performing functions similar to those of the circuit of FIG. 1.

Since the circuit of FIG. 2 only illuminates light during one half-cycle of the current, at a very low intensity a light bulb will produce a slight flicker giving the appearance of candlelight. Of course this may be avoided, if not desired, by adjusting the PUT anode voltage control resistors so that the initial-on brightness is beyond the slight flicker range while still at a very low brightness.

However, by using one of these control circuits to supply current to the light bulb during the positive half-cycle of the applied A.C. power and another identical control circuit to supply current to the light bulb during the negative half-cycle of the supplied power, the light bulb when fully on will emit light at its rated capacity. Such an arrangement is shown in FIG. 3.

Figure 3:
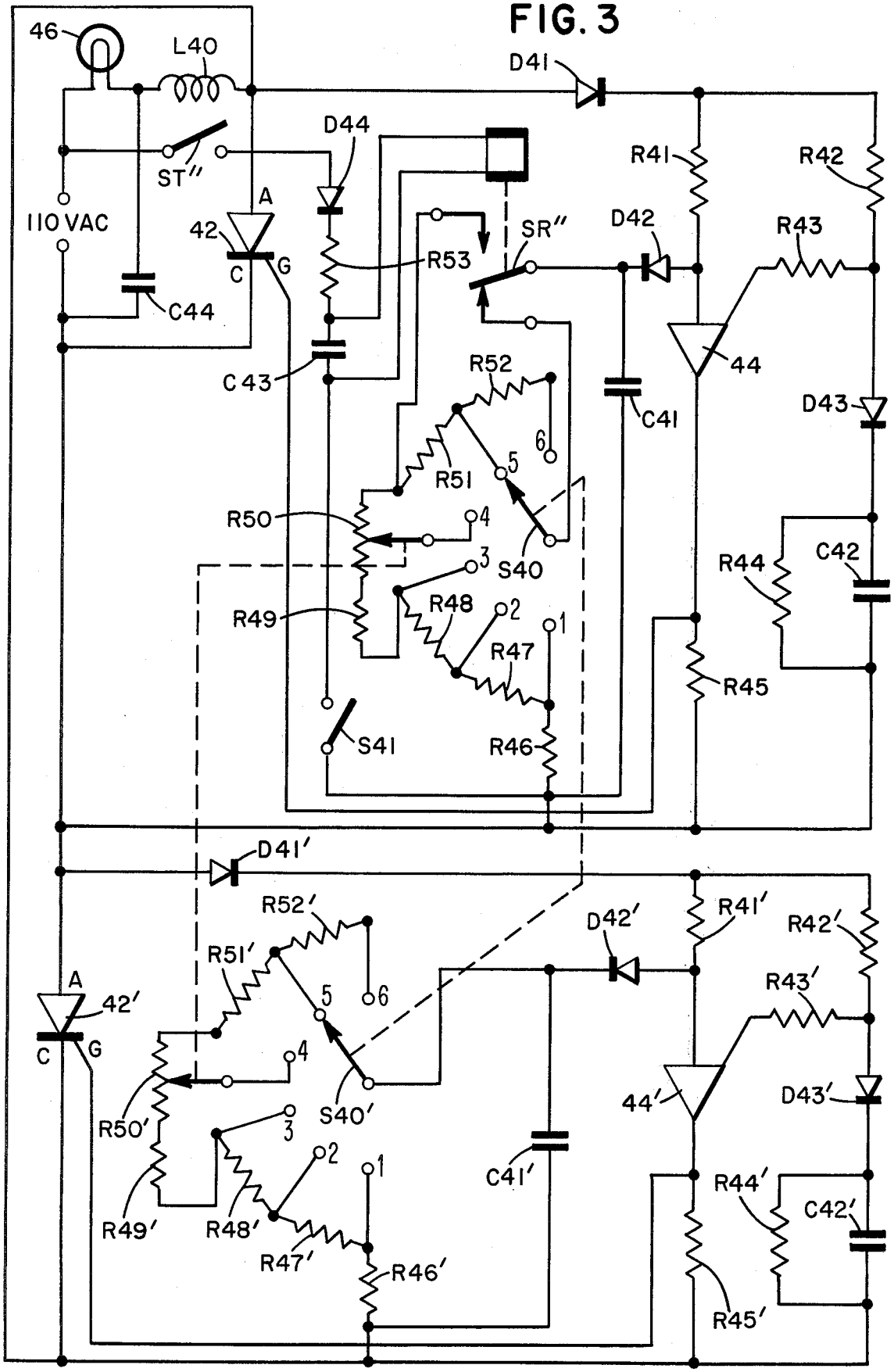
FIG. 3 shows another circuit according to the present invention and similar to the circuit of FIG. 2.

Referring to FIG. 3, the light bulb 46, capacitor C44, and coil L40 are common to each control circuit. Capacitor C43, diode D44, resistor R53, switch S41, timer switch ST" and relay switch SR" are shown in the top half of the circuit only. Both circuits can be controlled by using a double pole double throw relay SR". With the switch S40 of one circuit ganged with switch S40' of the second circuit, the gradual on and gradual off sequences as described above for one circuit produce the full swing in light intensity from off to full rated illumination and vice versa. By using resistive values for R41, R42, R44 and R46–R52 closely matching the values for R41', R42', R44' and R46'–R52' respectfully in the circuit, the light intensity can be made to stop at or between partial values as described above for a single control circuit. The automatic dawn producing circuit still consists of the top half of the circuit only, but could involve both halves as indicated.

When the two control circuits are thusly combined, the values of resistors R42, R44, R42' and R44' must be reduced to prevent one circuit from interfering with the trigger circuit for the PUT of the other circuit. To compensate for the reduction of the values of these resistors, the value of capacitors C42 and C42' must be increased proportionally. Suitable values for these components are: R42, R42'=235KΩ, R44, R44'=90KΩ and C42, C42'=200MF. The values of the other components may be the same as given in Table 2.

The connections to coil L40 and capacitor C44 are slightly different from FIG. 2. Here, the cathode of the SCR 42' is connected to resistors R44', R45', and R46' and capacitor C42' and also connected to the anode of SCR 42 and to the anode of diode D41. Likewise, the anode of SCR 42' is connected to the anode of diode D41', capacitor C42, and resistors R44, R45 and R46, as shown.

It should be understood that although the foregoing description illustrates the lighting of but a single bulb, the circuits of FIGS. 1, 2 and 3 may also be used to illuminate a plurality of lights or lighting system provided that the rate current of the silicon controlled rectified is not exceeded. Suitable SCR's exist with rated capacity ranging from a fraction of an ampere to several thousands ampere. Thus with a properly selected SCR, the control device may also be used to gradually vary the power supplied to an electric stove and thus the temperature of a heating element, or to gradually change the temperature of a heating lamp, or to gradually change the speed of an electric motor.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A device for producing a gradual change in power supplied to a load comprising:

a first solid state switching device having first and second power electrodes and a gate electrode, a variable timer network connected to said gate electrode and comprising a chargeable capacitor and a switchable resistive network, a first light emitting diode connected to receive current passed by said switching device and emit light proportional to the received current, a first photoresistor positioned to receive light emitted by said first light emitting diode, a second solid state switching device having first and second power electrodes and a gate electrode and controlling the supply of current to said load, said first photoresistor being connected to the gate of said second switching device whereby power is supplied to said load as a function of the light received by said first photoresistor from said light emitting diode, said resistive network being adjustable so that with said capacitor, said timer network controls the rate of change of voltage to the gate electrode of said first switching device and thereby the rate of change of power supplied to said load.

2. A device as in claim 1 and wherein:

said switchable resistive network includes a first switch (SA) having a first position (SA2) for enabling charging of said capacitor and a second position (SA1 or 3) for enabling discharge of said capacitor whereby in said first position said light emitting diode increases in light intensity and in said second position said light emitting diode decreases in intensity.

3. A device as in claim 2 and wherein:

said switchable resistive network includes timer switch (ST) means, a second light emitting diode (12) connected to receive electric current upon actuation of said timer switch, a second photoresistor (18) positioned to receive light emitted by said second light emitting diode, means for limiting the current to said second light emitting diode so that said second light emitting diode will flash on and off once upon actuation of said timer switch and momentarily lower the resistance of said second photoresistor and enable the power supplied to said load to turn on at a minimum initial level.

4. A device as in claim 3 and wherein:

said switchable resistive network includes a plurality of selectable resistors for selectively enabling different rates of increase and different rates of decrease in supplied power, and a second switch (SB) for selecting the desired of said resistors.

5. A device as in claim 4 and wherein:

said timer switch means includes a timer switch and a secondary switching device whereby actuation of said timer switch activates said secondary switching device and connects said first and second switches and thereby increases power supplied to said load at a rate determined by a variable resistor (R7).

6. A device as in claim 2 and wherein:

said switchable resistive network includes a variable resistor (R2) for adjusting the minimum voltage supplied to said gate electrode and thereby the minimum power supplied to said load.

7. A device as in claim 5 or 6 and wherein said first switching device comprises a junction field effect transistor.

8. A variable power intensity control circuit, comprising:

(a) a power input line, (b) a power output line adapted to be connected to an electrical load, (c) electrical conducting means connecting between the power input and power output lines for passing a variable amount of electrical energy from the input to the output line to thereby control the load intensity supplied to the electrical load, (d) a control element connected to the electrical conducting means for regulating the amount of electrical energy passed therethrough dependent upon the electrical state of the control element, and (e) control circuit means connected to the control element and having a plurality of manually selectable settings for supplying a selected variably increasing or decreasing power output dependent upon such settings and present power output so as to vary the electrical state on the control element to provide an instantaneous change ranging from negligible to significant in the power supplied followed by a gradually increased or decreased power supply through the electrical conducting means at a preselected instantaneous change in power and rate of change in power dependent upon such settings to a given preselected power level such that the power supplied to the load varies in accordance therewith.

9. The variable power intensity control circuit as set forth in claim 8, wherein:

(a) the electrical conducting means being a first gated solid state switching device having an anode and a cathode, (b) the control element including a second solid state switching device having a gate connected to the output of said first switching diode, (c) variable timing network connected to the anode of said first switching device and comprising a chargeable capacitor (C21) and a switchable resistive network for controlling the rate of change of voltage to the anode of said first switching device, (d) diode means for blocking one half-cycle of current to said variable timing network, (e) means for maintaining a voltage on the gate of said first switching device within a range such that the anode voltage control circuit causes said first switching device to fire as a function of the variable timing network, (e) whereby said second switching device conducts current to said load when said first switching device fires and blocks current flow to said load when said first switching device does not fire.

10. The variable power intensity control circuit as set forth in claim 9, and wherein said switchable resistive network comprises a plurality of serially connected resistors (R26–32) and a switch member (S20) for selectively connecting at least one of said resistors in parallel with said chargeable capacitor and with timer switch means.

11. The variable power intensity control circuit as set forth in claim 10, and wherein said plurality of resistors includes a first set of said resistors for controlling the rate of increase of power supplied to said load and for obtaining and maintaining the full power steady state condition, and a second set of resistors for controlling the rate of decrease of power supplied to said load and for obtaining and maintaining the no power steady state condition.

12. The variable power intensity control circuit as set forth in claim 11, and wherein the variable timing network includes a timer associated with the chargeable capacitor and the switchable resistive network for thereby increasing power supplied to the load at a controlled gradually increasing selective rate.

13. The variable power intensity control circuit as set forth in claim 12, and wherein said serially connected resistors include a variable resistor (R30) for controlling the final steady state condition of partial power supplied to said load and for controlling the rate of change in power supplied to the said load during the transition from one final steady state condition of partial power to the said load to another such steady state condition.

14. The variable power intensity control circuit as set forth in claim 13, and wherein said means for maintaining a voltage bias on the gate of said first switching device comprises a parallel connected resistor and second capacitor circuit connected through a blocking diode to the gate of said first switching device, whereby when said first set of resistors of said switchable resistive network is selected, said second capacitor of said circuit discharges more than it charges while the supplied power is increasing and when said second set of resistors of said switchable resistive network is selected, said second capacitor charges more than it discharges while the supplied power is decreased and said second capacitor discharges and charges at substantially equal rates when power is supplied to said load at a constant rate.

15. The variable power intensity control circuit as set forth in claims 8, 9, 10, 11, 12, 13, or 14 for supplying alternating current to said load and including:

(a) a third gated solid state switching device (44') having an anode and a cathode, (b) a forth solid state switching device (42') having a gate connected to the output of said third switching device, (c) a second variable timing network connected through a blocking diode to the anode of said third switching device and comprising a third chargeable capacitor (C41') and a second switchable resistive network for determining the discharging time of the said third capacitor, (d) a resistive network (R41') connected between the power source and the anode of the said third switching device, for determining the charging time of the said third capacitor and in conjunction with said second switchable resistive network determines the maximum fraction of supplied voltage to be across the said third capacitor and on the anode of said third switching device, (e) second diode means for passing said one half-cycle of current to anode and grid circuits of said third switching device and blocking the other half-cycle of current, and (f) means for maintaining a voltage on the gate of said third switching device within a range such that the anode voltage control circuit causes said third switching device to fire as a function of the ratio of the resistance in said charging network of said third capacitor to the resistance of the said discharging circuit for the said third capacitor, whereby said fourth switching device conducts current to said load for the remainder of the half-cycle of supplied power when the said third switching device fires and blocks current to the said load during the portion of each half-cycle of supplied power prior to the firing of the said third switching device.

16. A device as in claim 15 and wherein said first and third switching devices are programmable unijunction transistors and said second and fourth switching devices are silicon controlled rectifiers.

17. A device as in claims 9, 10, 11, 12, or 13 and wherein said first switching device is a programmable unijunction transistor and said second switching device is a silicon controlled rectifier.

* * * * *

UNITED STATES PATENT AND TRADEMARK OFFICE

CERTIFICATE OF CORRECTION

PATENT NO. : 4,379,237

DATED : April 5, 1983

INVENTOR(S) : Lawson P. Mosteller, Jr.

It is certified that error appears in the above-identified patent and that said Letters Patent is hereby corrected as shown below:

Column 5, line 37, change "HED" to "HEP".
" 5, line 46, change "Sb" to "SB".
" 6, line 68, delete "instantaneously".
" 8, line 5, change "C21 C23" to "C21 - C23".
" 12, line 40, insert "gate" after "second".
" 12, line 41, change "a gate" to "an output".
" 12, line 42, change "output" to "gate".
" 12, line 42, change "diode" to "device".
" 12, lines 44, 47,51, and 52, change "first" to "second".
" 12, line 55, change "second" to "first".
" 12, line 56, change "first" to "second".
" 12, line 58, change "first" to "second".
" 13, lines 24, 27, change "first" to "second".
" 14, line 35, change "first" to "second".
" 14, line 37, change "second" to "first".
" 14, line 40, change "first" to "second".
" 14, line 41, change "second" to "first".

Signed and Sealed this

*Thirteenth* Day of *September 1983*

[SEAL]

*Attest:*

GERALD J. MOSSINGHOFF

*Attesting Officer*

*Commissioner of Patents and Trademarks*